United States Patent [19]

Hackney

[11] Patent Number: 4,602,585

[45] Date of Patent: Jul. 29, 1986

[54] JIB SAIL AND BATTEN COMBINATIONS

[76] Inventor: John Hackney, P.O. Box 1146, Jensen Beach, Fla. 33457

[21] Appl. No.: 681,614

[22] Filed: Dec. 14, 1984

Related U.S. Application Data

[63] Continuation-in-part of Ser. No. 486,216, Apr. 18, 1983, Pat. No. 4,535,825.

[51] Int. Cl.[4] ..... B63H 9/04

[52] U.S. Cl. ..... 114/103

[58] Field of Search ..... 114/102, 103; D21/317

[56] References Cited

U.S. PATENT DOCUMENTS

| | | | |
|---|---|---|---|
| 3,557,733 | 1/1971 | Mathieu et al. | 114/102 |
| 3,581,698 | 6/1971 | Bete | 114/103 |
| 4,335,669 | 6/1982 | Hackney | 114/103 |

*Primary Examiner*—Sherman D. Basinger

*Attorney, Agent, or Firm*—Carroll F. Palmer

[57] ABSTRACT

Jib sails for sailcraft comprising full length battens have batten pockets provided with rigid cups at their fore ends that have their opened ends facing aft to receive mating luff caps on the fore ends of the battens. The combination of such a rigid cup with a luff cap eliminates tearing of the sail luff by a batten when it is compressed in its batten pocket to create camber in a jib sail.

4 Claims, 5 Drawing Figures

FIG. 1
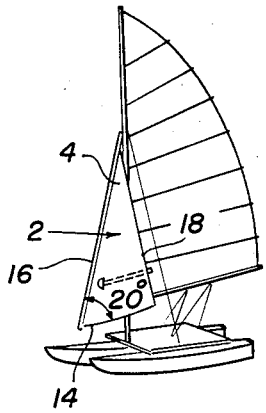
FIG. 3
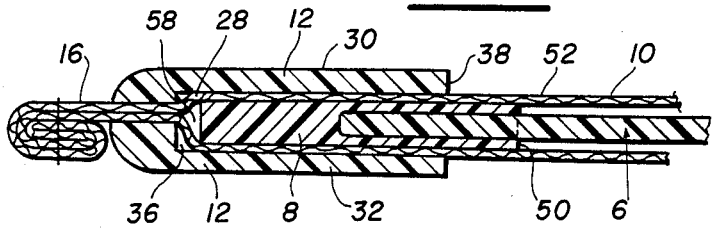
FIG. 2
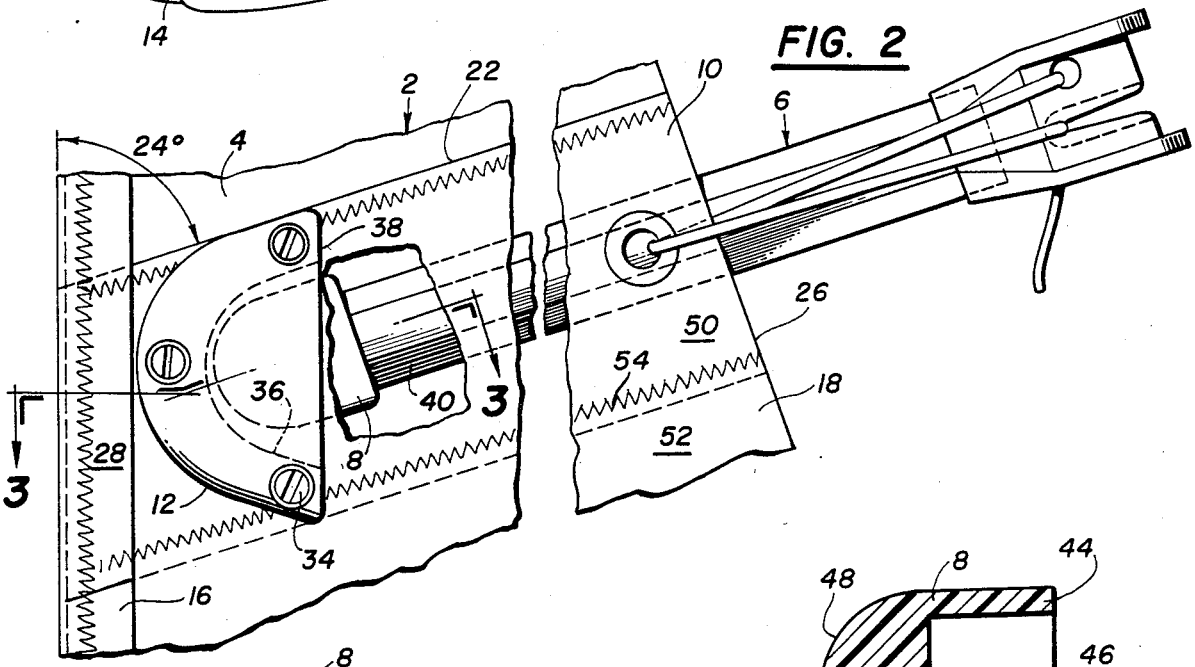
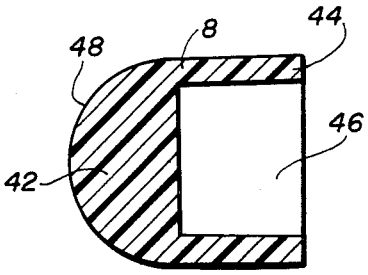
FIG. 4
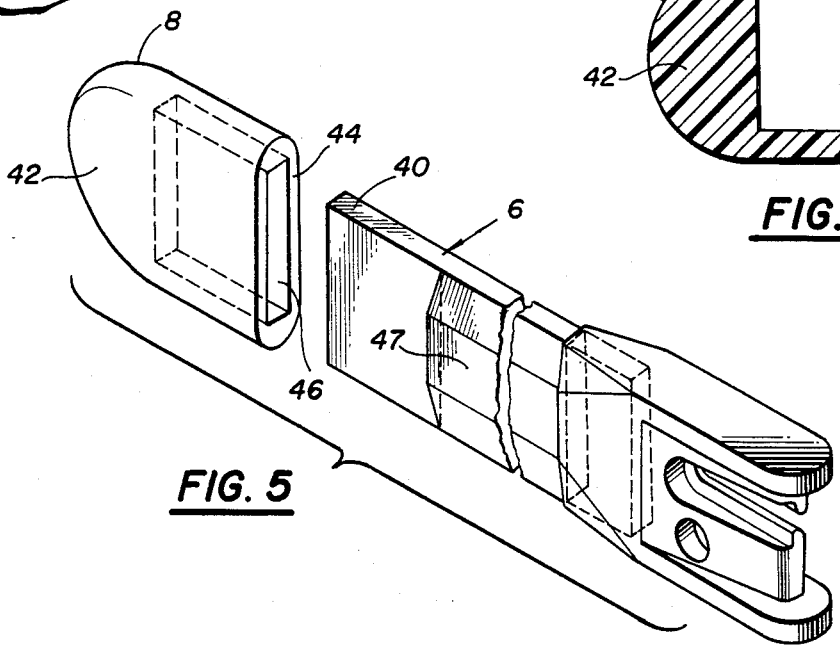
FIG. 5

JIB SAIL AND BATTEN COMBINATIONS

CROSS-REFERENCE TO RELATED APPLICATIONS

This application is a continuation-in-part of copending application Ser. No. 486,216, filed Apr. 18, 1983 for "Sail Batten Improvements", now U.S. Pat. No. 4,535,825 the disclosure of which is incorporated herein by reference.

BACKGROUND OF THE INVENTION

1. Field of the Invention

This invention relates broadly to improvements in battens for sails of boats and other sailcraft. More particularly, it concerns novel forms of sail batten luff caps, improved sail battens comprising such caps and new sail/batten combinations.

2. Description of the Prior Art

As explained in my previous U.S. Pat. No. 4,335,669, the disclosure of which is incorporated herein by reference, battens are extensively used with sails for sailcraft, e.g., sailboats, iceboats, wind propelled scooters, sailboards, etc., to support and/or shape the sails. The sails with which battens are used include lugsails, lateen sails, square-rigged sails, jib-headed (Marconi rig) sails and gaff rig sails. This invention pertains to battens for jib-headed sails.

Jib-headed sails may be divided into several classes with respect to battens, namely, unbattened sails, partial batten sails and full battened sails. The battens serve, in part, to support roach (excess cloth) formed into the leech of the sail. Hence, sails, e.g., those often used on cruising boats, made without roach do not need battens so are unbattened.

In racing sailboats, iceboats and other racing sailcraft, high performance is demanded of the sails. The sails for such sailcraft are usually made with a high degree of roach and require battens to provide proper leech shape. The partial batten type sails use battens that are carried in pockets extending forward from the leech only a minor length of their chords of the sails. In contrast, full battened (FB) sails use battens carried in pockets that extend all the way from the leech to the luff of the sail. The full type (FT) battens are longer than their respective pockets and by compressing such batten in their pockets between the luff and the leech, the battens can be caused to bow. The greater the compression, the greater the bow creating larger camber in the sail. Hence, compression on FT battens is used by the sailcraft operator to control sail shape to obtain maximum performance from the sail for the prevailing wind conditions.

Compression on FT battens drives their fore ends into the leading edge of the batten pocket and into the sail luff. Consequently, the sail cloth in the pocket and the luff is subjected to excessive wear, often resulting in the batten producing a hole in the sail at the luff. Such damage to the sail is particularly severe where FT battens are used with jib sails, e.g., the foresails on sloop and cutter rigs, because of the violent movements such foresails make in tacking and other maneuvers of sailcraft on which they are carried. Hence, a special need exists for providing means to eliminate excessive luff wear by FT battens in jib sails.

OBJECTS

A principal object of the present invention is the provision of new improvements in sail/batten combinations. Further objects include the provision of:

(1) Improved forms of sail/batten combinations designed to mitigate compression damage to the luff portions of jib sails using FT battens.

(2) Novel sail batten pocket and sail batten combinations.

(3) Improved forms of full battened jib sails.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished in accordance with the present invention by the provision of new sail/batten combinations for jib sails of sailcraft.

The new jib sail and batten combinations comprise a jib sail of triangular shape defined by a foot, luff and leech with the axis of the luff forming an acute angle with the axis of the foot.

A sail batten pocket is formed in the sail spaced apart from the foot extending from the leech to the luff and the longitudinal axis of the pocket forms, on its side opposite to the foot, an acute angle with the axis of the luff. The batten pocket has an open aft end and a closed fore end.

There is a rigid cup formed of a pair of substantially identical dished members fixed astride of the batten pocket adjacent its closed fore end defining an round bottomed trough opened toward the leech of the sail.

A batten is positioned in the batten pocket, and a luff cap is fitted on its fore end. Such luff cap comprises a fore portion and integral aft portion. There is means on such aft portion attaching the cap to the batten, and the fore portion of the cap is approximately semi-circular in cross-section in the plane of said luff.

In preferred embodiments of the invention, the means for fixing the new luff caps to battens is a slot in the aft portion of a size and shape to tightly envelope the fore ends of the battens, but other fixing means may be used. The fore portions of the new luff caps may be solid or, alternatively, they may be made with transverse openings to make them lighter. Further, in preferred embodiments the jib sails are jib-headed and the sail leech is provided with means to compress said batten into the batten pocket.

BRIEF DESCRIPTION OF THE DRAWINGS

A more detailed understanding of the new combinations of the invention may be had by reference to the accompanying drawings in which:

FIG. 1 is a schematic prospective view of a catamaran sailboat equipped with a jib sail/batten combination containing new FT battens of the invention.

FIG. 2 is a fragmentary, lateral view of a FT batten and sail combination of the invention.

FIG. 3 is a fragmentary, sectional view taken on the line 3—3 of FIG. 2.

FIG. 4 is a lateral, sectional view of a new batten luff cap of the invention.

FIG. 5 is an exploded, fragmentary, isometric view of a luff cap and batten combination of the invention.

DESCRIPTION OF THE PREFERRED EMBODIMENTS

Referring in detail to the drawings, a sail/batten combination 2 of the invention for a full battened jib 4 comprises a batten 6, luff cap 8, batten pocket 10 and rigid cup member 12.

The jib 4 is of triangular shape defined by a foot 14, luff 16 and leech 18. The axis of the luff forms an acute angle 20 with the axis of the foot.

The sail batten pocket 10 is formed in the sail 4 spaced apart from the foot 14 and extends from the leech 18 to the luff 16. The longitudinal axis of the pocket 10 forms, on its side 22 opposite to the foot 14, an acute angle 24 with the axis of the luff 16. The pocket 10 includes an open aft end 26 and a closed fore end 28.

The rigid cup 12 is formed of a pair of substantially identical dished members 30 and 32 that are fixed by fasteners 34 astride the pocket 10 adjacent the closed fore end 28. The cup 12 defines an round bottomed trough 36 opened at the aft end 38 toward the leech 18 of the jib 4.

The batten 6 positioned in the batten pocket 10 has the luff cap 8 fitted on its fore end 40. Such cap comprises a fore portion 42 and integral aft portion 44. The aft portion 44 contains a slot 46 which serves as means for fixing the cap 8 to batten 6. As illustrated, the slot 46 has a simple rectangular cross-section to mate with the unribbed, fore portion 40 of batten 6. Cement, adhesive, or the like may be applied between the slot inner-surface and the outer-surface of batten portion 40 to ensure permanent connection between the parts.

If the battens 6 have reinforcement ribs 47 that extend the entire length of thereof (not shown), the slots in the luff caps would be shaped as a female opening (not shown) to sungly receive the batten fore portion. Also, other means for fixing the caps to the battens may be used, e.g., luff caps (not shown) with solid aft portions can be butt welded to the front edges of the battens.

The cap 8 has a leading edge 48 that is approximately semi-circular so that the cap fore portion 42 is approximately semi-circular in cross-section in the plane of the jib luff 16.

The fore portions 42 of luff caps 8 consist of a solid section. In modified form of luff caps (not shown) the fore portions may have transverse openings therethrough. This serves to lessen the cap weight without serious harm to the cap strength. The width of the fore portion 42 may also be reduced relative to the width of the aft portion (not shown) also for weight reduction.

The construction of the pockets 10 is not critical to the present invention, i.e., the new sail/batten combinations 2 are intended for use with sails and sail pockets of any conventional style of FT battened sails. Typically, batten pockets of such sails comprise a layer 50 of sailcloth fixed to the sailcloth 52 of the sail 4 by stitching 54.

The batten 6 is preferably provided with constraining device 56 shown as of the type described and claimed in U.S. Pat. No. 4,335,669, but any other type of constraining device for battens may be used in practicing the present invention. The device 56 is used as explained in U.S. Pat. No. 4,335,669 to cause the batten 10 to bow and thereby induce camber in the jib 4.

The fore end 28 of the pocket 10 is closed and is adjacent the sail luff 16 and substantially parallel thereto. When installed properly in a sail pocket 10, the leading edge 48 of the new batten cap 8 bears against the fore ends 58 of the pockets 10 with these two parts in line-to-line contact.

The rigid cup 12 serves as a bearing member for the luff cap 8 of the batten 6 carried in the pocket 10. The cups may be molded of rigid plastic, stamped from metal or made in any other suitable manner.

The new luff caps 8 are preferably made by injection molding from rigid plastic, e.g., nylon, ABS, etc., but they may also be made of any other suitable material, e.g., metal, wood, etc., by any desired fabrication method.

The embodiments of the invention in which an exclusive property or privilege is claimed are defined as follows:

1. A sailcraft jib sail and batten combination comprising:

a jib sail of triangular shape defined by a foot, luff and leech, the axis of said luff forming an acute angle with the axis of said foot, a sail batten pocket formed in said sail spaced apart from said foot extending from said leech to said luff, the longitudinal axis of said pocket forming on its side opposite to said foot an acute angle with said axis of said luff, an open aft end in said batten pocket, a closed fore end in said batten pocket, a rigid cup formed of a pair of substantially identical dished members, said members being fixed astride of said pocket adjacent said closed fore end defining an round bottomed trough opened toward the leech of said sail, a batten in said batten pocket, and a luff cap fitted on the fore end of said batten, said luff cap comprising, a fore portion and integral aft portion, means on said aft portion attaching said cap to said batten, and said fore portion being approximately semi-circular in cross-section in the plane of said luff.

2. The combination of claim 1 wherein said sail is jib-headed.

3. The combination of claim 1 wherein said sail leech is provided with means to compress said batten into said pocket.

4. The combination of claim 1 wherein said means on said aft portion of said luff cap is an opening that envelopes said fore end of said batten.

* * * * *